US009282857B1

(12) United States Patent
Khiroya

(10) Patent No.: US 9,282,857 B1
(45) Date of Patent: Mar. 15, 2016

(54) TOILET SEAT

(71) Applicant: Anish Vijay Khiroya, Rohnert Park, CA (US)

(72) Inventor: Anish Vijay Khiroya, Rohnert Park, CA (US)

( * ) Notice: Subject to any disclaimer, the term of this patent is extended or adjusted under 35 U.S.C. 154(b) by 204 days.

(21) Appl. No.: 13/987,016

(22) Filed: Jun. 24, 2013

Related U.S. Application Data

(63) Continuation-in-part of application No. 13/374,996, filed on Jan. 26, 2012, now Pat. No. 8,925,120.

(51) Int. Cl.
*A47K 13/24* (2006.01)

(52) U.S. Cl.
CPC ..... *A47K 13/24* (2013.01)

(58) Field of Classification Search
CPC ..... A47K 13/005; A47K 13/02; A47K 13/26; A47K 13/06
USPC ..... 4/239
See application file for complete search history.

(56) References Cited

U.S. PATENT DOCUMENTS 3,371,356 A * 3/1968 Burton ..... 4/239
D390,931 S * 2/1998 Jackson ..... D23/311
2005/0235404 A1* 10/2005 Jiang ..... A47K 17/026 4/237

FOREIGN PATENT DOCUMENTS

JP 11076102 A * 3/1999

* cited by examiner

*Primary Examiner* — Janie Christiansen
(74) *Attorney, Agent, or Firm* — Risto A. Rinne, Jr.

(57) ABSTRACT

An apparatus for providing easy access to a person's bottom while using a toilet includes a thicker-style of seat placed directly over a rim of a toilet bowl. The apparatus includes a pair of side access openings that are located on a left and an opposite right side of the seat. The access openings allow for easy access to the bottom of the person for hygienic cleaning after using the toilet. The person reaches through either side access opening while holding a quantity of toilet paper and wipes their bottom with a side-to-side or front-to-rear motion, thereby reducing a potential risk for contracting a urinary tract infection. At least one clamp assembly that is used to secure the seat in position extends downward from the seat and is adjustable to apply tension to the apparatus sufficient to secure it proximate the rim.

19 Claims, 4 Drawing Sheets

TOILET SEAT

This application is a continuation-in-part of utility application Ser. No. 13/374,996 entitled "Commode/Toilet Seat" that was filed on Jan. 26, 2012 by the same inventor, Anish Vijay Khiroya, wherein this application claims the benefit of the date of priority of application Ser. No. 13/374,996. Additionally, the entire content of application Ser. No. 13/374,996 is included herein by way of reference.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to toilet seats and, more particularly, to an improvement to a toilet seat.

Toilet seats are well known. Toilet seats are a standard part of the toilet and provide a place for a person to sit while the toilet is being used.

Commercial toilet seats located in public restrooms tend to be larger in size than residential toilet seats. Regardless of the type of toilet seat, commercial or residential, there is typically a small amount of room provided for a person to cleanse themselves after using the toilet if the person remains sitting on the toilet seat.

If a person is disabled, it may be quite difficult to properly cleanse their bottom to a hygienic level. They may not possess enough dexterity in their hands to reach through a center opening provided in the toilet seats and be able to access their bottom. If the bottom is not thoroughly cleansed after a bowel movement, discomfort and infection may occur.

In addition, elderly persons may experience the same aforementioned difficulties using prior art toilet seats. It also may be difficult for the elderly person to fully balance themselves while reaching through the center opening of the toilet seat to cleanse themselves.

In addition, it is advised that a wiping of one's bottom should be done using a rearward wiping motion. This is especially advised for women. If wiping is done with a back to front wiping motion, women are subject to a higher risk of acquiring a urinary tract infection.

Conventional toilet seats do not permit easy rearward wiping due to their design. It is difficult to partially lift one's buttocks and reach through the center opening and wipe using only a rearward motion. In some cases, people may resort to standing up above the toilet seat to wipe their bottom, however, this technique may be impossible for disabled or elderly persons. It is certainly awkward for all others.

Accordingly, there exists today a need for a toilet seat that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Toilet seats are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 6,868,561 to Myers, that issued on Mar. 22, 2005;

U.S. Pat. No. 2,810,914 to Hamilton, that issued on Oct. 29, 1957;

U.S. Pat. No. 2,241,967 to Sperzel, et al., that issued on May 13, 1941; and

U.S. Pat. No. Re. 20,696 to Sperzel, et al., that issued on Apr. 12, 1938.

And including U.S. Design Patents:

U.S. Design Pat. No. Des. 408,901 to Machanic, that issued on Apr. 27, 1999;

U.S. Design Pat. No. Des. 287,534 to Broeils, that issued on Dec. 30, 1986; and

U.S. Design Pat. No. Des. 242,457 to Landsberger, that issued on Nov. 23, 1976.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a toilet seat that may be used with a conventional toilet.

It is also an important object of the invention to provide a toilet seat that may be retrofitted (i.e., secured) onto a conventional toilet to provide an alternate toilet seat.

Still another object of the invention is to provide a toilet seat that may be used with a conventional toilet by simply placing the toilet seat atop an existing prior art type of toilet seat or atop a seat on a commode or, preferably, by placing the toilet seat onto a rim of a bowl of the conventional toilet after an original seat of the conventional toilet has been placed in a raised position.

Still yet another object of the invention is to provide a toilet seat that may be placed on a rim of toilet bowl.

Yet another important object of the invention is to provide a toilet seat that may be hingedly-attached to a conventional type of toilet, if long term mounting is desired.

Still yet another important object of the invention is to provide a toilet seat that includes a left side access opening located on a left side of the toilet seat and an opposite right side access opening located on a right side of the toilet seat.

A first continuing object of the invention is to provide a toilet seat that includes a first and a second side access opening that permits access to a bottom of a person sitting upon the toilet seat.

A second continuing object of the invention is to provide a toilet seat that can be placed on a rim of a toilet bowl and secured in position by tightening one or more clamps that are included.

A third continuing object of the invention is to provide a toilet seat that allows a person to clean their bottom while sitting on the toilet seat using a front-to-rear wiping motion direction with a quantity of toilet paper.

A fourth continuing object of the invention is to provide a toilet seat that can be placed on a seat of a toilet and secured in position by tightening one or more extended length clamps that are included.

A fifth continuing object of the invention is to provide a toilet seat that includes a thickness of approximately four inches.

A sixth continuing object of the invention to provide a toilet seat that may include any desired thickness.

A seventh continuing object of the invention is to provide a toilet seat that includes a thickness that places a person higher up for easier mounting and dismounting from a conventional type of toilet.

An eighth continuing object of the invention is to provide a toilet seat that may be used on a residential or a commercial type of toilet.

A ninth continuing object of the invention is to provide a toilet seat that lessens a risk for contracting a urinary tract infection.

A tenth continuing object of the invention is to provide a toilet seat that is comfortable.

Briefly, a toilet seat that is constructed in accordance with the principles of the present invention has a relatively thick seat for use with a conventional toilet. The toilet may be either a commercial or a residential toilet. The size of the toilet seat may only be for one type of toilet or it may include a universal design to accommodate both residential and commercial sizes. An original toilet seat of the toilet is preferably raised prior to placement of the toilet seat onto a rim of a toilet bowl. One or more clamps attached to the toilet seat are tightened to secure the toilet seat in position. A thin right upper portion and an opposite thin left upper portion of the toilet seat extend across a top surface of the toilet seat and connects with a wider front portion and a wider rear portion to form a generally circular structure that includes a smooth upper surface of the toilet seat. A thin right lower portion is disposed under the thin right upper portion. The right lower portion includes a width that is generally equal to a maximum width of the toilet seat. Therefore, the width of the right lower portion is greater than the width of the right upper portion. A thin left lower portion is disposed under the thin left upper portion. The left lower portion includes a width that is generally equal to a maximum width of the toilet seat. Therefore, the width of the left lower portion is greater than the width of the left upper portion. The right and left lower portions provide a continuous lower surface that extends fully around the bottom of the toilet seat, thereby, greatly increasing its strength. If desired, a large U-shaped front recess may be included on the front portion, which provides an extension for access to a center opening. The front recess, if included, provides easy access to a front pubic area of a person and also provides access to the center opening of the toilet. A left side access opening is included on a left side of the toilet seat between the left upper portion and the left lower portion. A right side access opening is included on an opposite right side of the toilet seat between the right upper portion and the right lower portion. The left and right side access openings allow the person, while still sitting on the toilet seat, to access their bottom for cleaning after using the toilet. The right and left side access openings permit the person sitting on the toilet seat to reach through the right and left side access openings of the toilet seat while holding a quantity of toilet paper and wipe their bottom using a side-to-side motion or a front-to-back motion. It is preferred that the right and left side access openings are utilized for cleansing of the bottom after a bowel movement instead of reaching through the recess, if included, located on the front portion of the toilet seat or through the center opening of the toilet seat. The right and left side access openings provide easier access to the person's bottom for proper hygienic cleaning. The right and left side access openings are especially convenient for women, elderly or disabled persons to properly clean themselves after using the toilet. By using the side-to-side or the front-to-back wiping motion, a potential risk for women to contract a urinary tract infection is decreased as bacteria is not brought forward to the vaginal area from the rear. Women are advised to wipe their bottoms using a rearward motion. This type of motion is not practical with prior art types of toilet seats. If desired, a pair of hinges may be included to hingedly-attach the toilet seat to the conventional toilet when the toilet seat will not be removed from the toilet for an extended period of time. The hinges allow the toilet seat to pivot upward or downward.

DETAILED DESCRIPTION OF THE INVENTION

Figure 1:
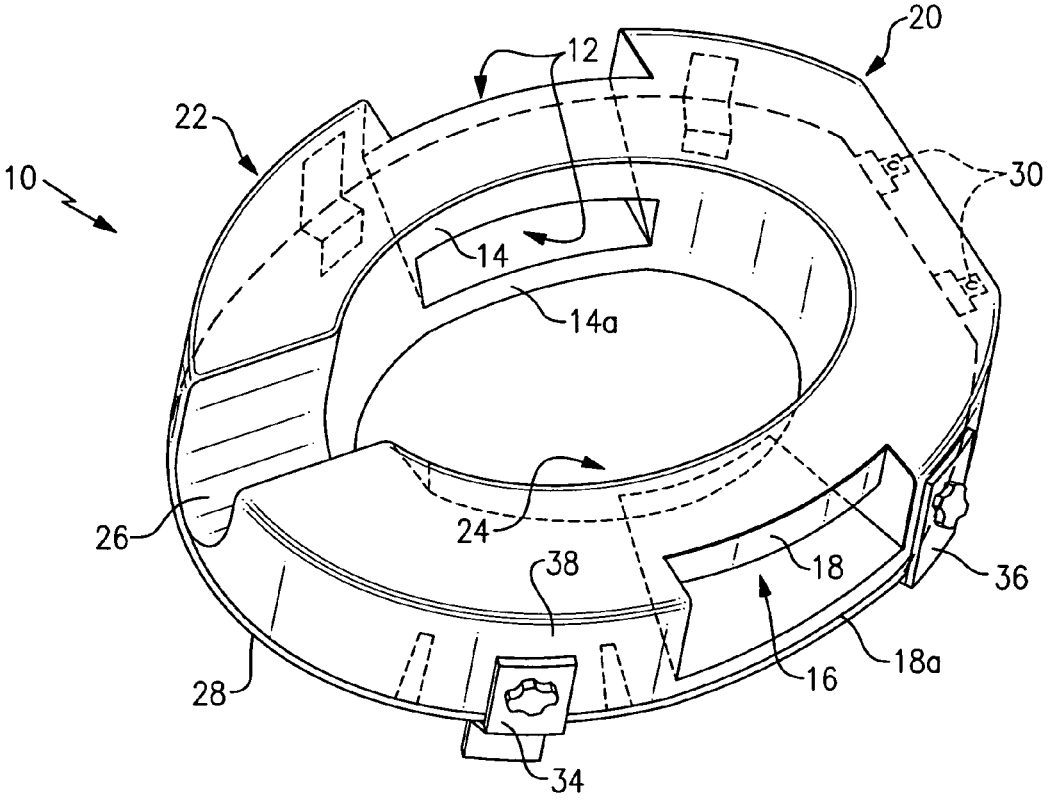
FIG. 1 is a view in perspective of a toilet seat.
Figure 2:
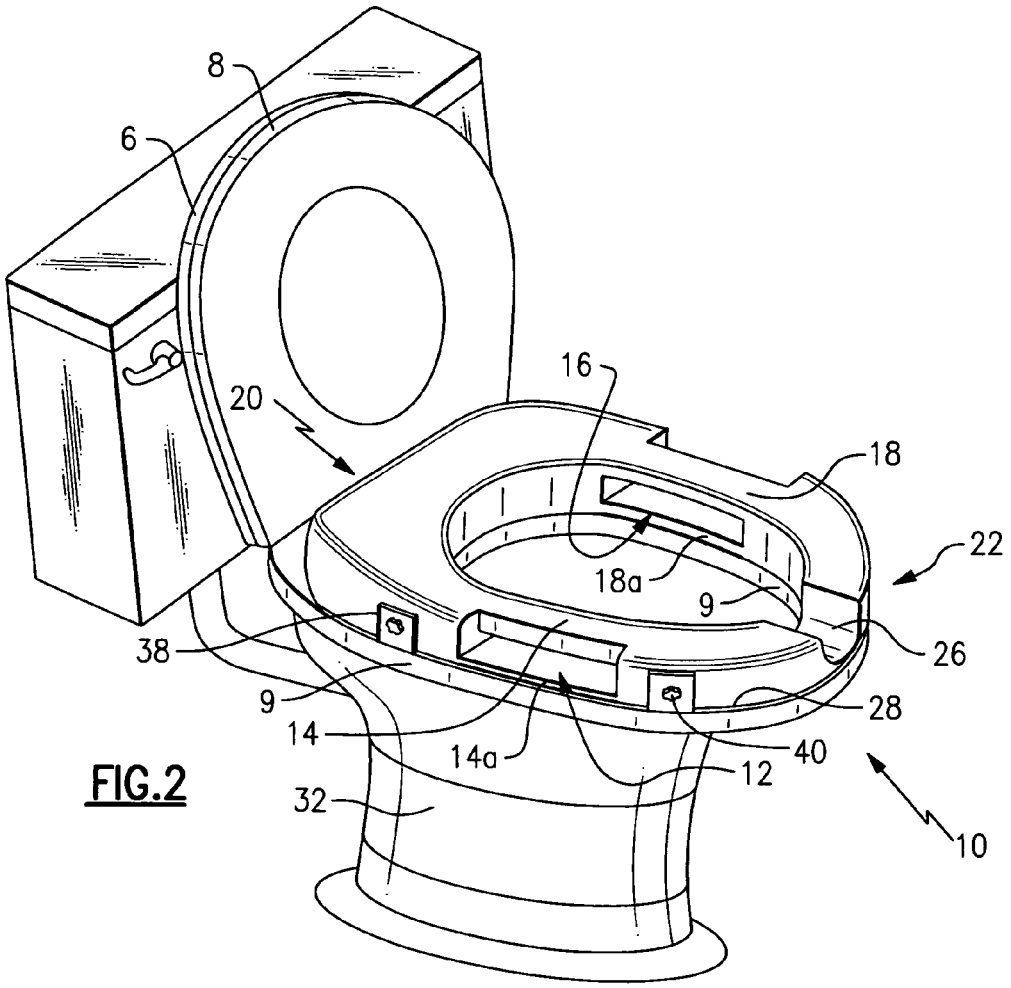
FIG. 2 is a view in perspective of the toilet seat of FIG. 1 disposed on a standard toilet.

Referring on occasion to all of the FIGURE drawings and now, in particular to FIG. 1 and on occasion to FIG. 2, is shown a toilet seat, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The toilet seat 10 is comprised of a thick seat that includes a raised height of approximately four inches, however any desired height may be included. The thickness of the toilet seat 10 helps raise a person (not shown) higher than a prior art toilet seat of a conventional toilet. This is useful for disabled or elderly persons in which less bending down to sit upon a top surface of the toilet seat 10 is required.

The toilet seat 10 can be used with a conventional toilet 32 (see FIG. 2). An original toilet seat cover 6 and an original toilet seat 8 of the toilet 32 are raised prior to placement of the toilet seat 10 onto a rim 9 of a bowl of the toilet 32.

The toilet 32 may be either a commercial toilet 32 or a residential toilet 32. Commercial types of the toilet 32 tend to be slightly larger in size than the residential type of toilet 32. The size of the toilet seat 10 may be designed to include a size for use with only the residential toilet 32 or with only the commercial toilet or it may include a universal design (i.e., size) to accommodate both types (commercial or residential) of the toilet 32.

The toilet seat 10 includes a left side access opening when viewed from the front, identified in general by the reference numeral 12. The left side access opening 12 is located below a thin left upper portion 14 of the toilet seat 10.

A right side access opening when viewed from the front, identified in general by the reference numeral 16, is located on an opposite right side below a thin right upper portion 18 of the toilet seat 10.

The left and the right side access openings 12, 16 include a size that is sufficiently large enough for the person to extend a hand and/or a portion of an arm (not shown) through either of the side access openings 12, 16.

The left and right upper portions 14, 18 extend across the top surface of the toilet seat 10, and connect with a rear portion, identified in general by reference numeral 20. The left and right upper portions 14, 18 further extend to connect with a front portion, identified in general by reference numeral 22. All portions 14, 18, 20 and 22 form a complete generally smooth and continuous circular or oval circumference for the toilet seat 10.

The left and right upper portions 14, 18 are slightly thinner in width than the rear and front portions 20, 22 to accommodate the left and right side access openings 12, 16. However, the top surface of the toilet seat 10 is large enough to provide a comfortable sitting area for the person to sit upon while using the toilet 32. The thinner width of the left and right upper portions 14, 18 is provided by removing some of the material of the left and right upper portions 14, 18 along an outer perimeter portion, thereof, over the left and right side access openings 12, 16.

A thin right lower portion 18*a* is disposed under the thin right upper portion 18. The right lower portion 18*a* includes a width that is generally equal to a maximum width of the toilet seat 10. Therefore, the width of the right lower portion 18*a* is greater than the width of the right upper portion 18.

A thin left lower portion 14*a* is disposed under the thin left upper portion 14. The left lower portion 14*a* includes a width that is generally equal to a maximum width of the toilet seat 10. Therefore, the width of the left lower portion 14*a* is greater than the width of the left upper portion 14.

A bottom plate 28 is attached to the bottom of the toilet seat 10 by any preferred way, such as by the use of screws, press-fit, snap-together latches, adhesive, hook and loop fastener or other means, as desired.

The bottom plate 28 extends fully around the bottom of the toilet seat 10. Accordingly, some of the thickness of the right lower portion 18*a* and the left lower portion 14*a* is increased by the thickness of the bottom plate 28.

The right and left lower portions 18*a*, 14*a* along with the bottom plate 28 provide a continuous lower surface that extends fully around the bottom of the toilet seat 10, thereby, greatly increasing its strength.

The left side access opening 12 is located between the left upper portion 14 and the left lower portion 14*a*. The right side access opening 16 is located between the right upper portion 18 and the right lower portion 18*a*.

The left and right side access openings 12, 16 provide access for the person to comfortably reach their bottom for cleaning after using the toilet 32. The left and right side access openings 12, 16 permit the person sitting on the toilet seat 10 to reach under the either the left upper portion 14 or under the right upper portion 18 while holding a quantity of toilet paper (not shown). The narrower width of the left and right upper portions 14, 18 allow the hand and/or arm of the person sitting on the toilet seat 10 to easily reach their bottom (i.e., anus) for cleaning.

The left and right side access openings 12, 16 are especially convenient for women, elderly or disabled persons to properly clean themselves after using the toilet 32.

Conventional toilet seats 8 included on either the commercial or residential type of toilet 32 do not provide adequate clearance for a person to easily reach their bottom for cleaning and no clearance for side access as the inventive toilet seat 10 provides. If the person is disabled with limited dexterity of their hands, accomplishing proper hygienic cleaning is difficult, if not impossible, to achieve.

It is also very difficult for a person sitting on the conventional toilet seat 8 to clean their bottom using anything other than a back-to-front wiping motion. This increases the risk of acquiring a urinary tract infection, especially for women. Furthermore, it is impossible to access one's bottom for cleaning from the side using the prior art type of toilet seat 8.

During use, the person performs the wiping motion by accessing their bottom through the left and right side access openings 12, 16. This provides an important unexpected benefit as disabled persons with limited dexterity in their hands are easily able to reach their bottoms to provide hygienic cleaning.

By using the left and right side access openings 12, 16 the person is then able to wipe their bottom using a side-to-side motion or a front-to-back motion. It is preferred that the left and right side access openings 12, 16 are utilized for cleansing of the bottom as they provide direct access to the bottom for cleaning.

By using the side-to-side wiping motion while cleaning a rectal area, an unexpected benefit is provided. The side-to-side wiping motion or the front-to-back wiping motion helps to decrease a potential risk for women to contract a urinary tract infection by avoiding contact with a vaginal pubic area during wiping of the rectal area. Bacterium that may be present in the rectal area is not brought forth to the vaginal area from the rear.

Women are advised to wipe their bottoms using a rearward motion to avoid contacting their vaginal area while wiping their rectal area. This is not practical with prior art types of toilet seats 8 and it is all but impossible for the elderly of disabled to accomplish with prior art types of toilet seats 8.

If access to the front pubic area is desired, a large front recess 26 may be included on a center of the front portion 22. The front recess 26 includes a U-shape and it provides easy access to the front pubic area of the person and also provides access to a center opening 24 area of the toilet seat 10.

During use the toilet seat 10 is placed directly over the rim 9 of the toilet bowl after first raising the toilet seat cover 6 and the original or conventional toilet seat 8, as shown in FIG. 2.

It is important to note that modification to the toilet 32 is not required to use the toilet seat 10. The toilet seat 10 is especially easy to install and can be done by most people, including many special-needs people and many disabled individuals. No tools are required for typical installation of the toilet seat 10. Installation is described in greater detail, below. Other, optional mounting methods for the toilet seat 10 are discussed later and may require the use of some tools or additional skill.

Four clamp assemblies 34, 36, 38, 40 are shown inserted into openings provided in the bottom plate 28. A detailed perspective view of one of the clamps 34 is shown in FIG. 3.

Figure 4:
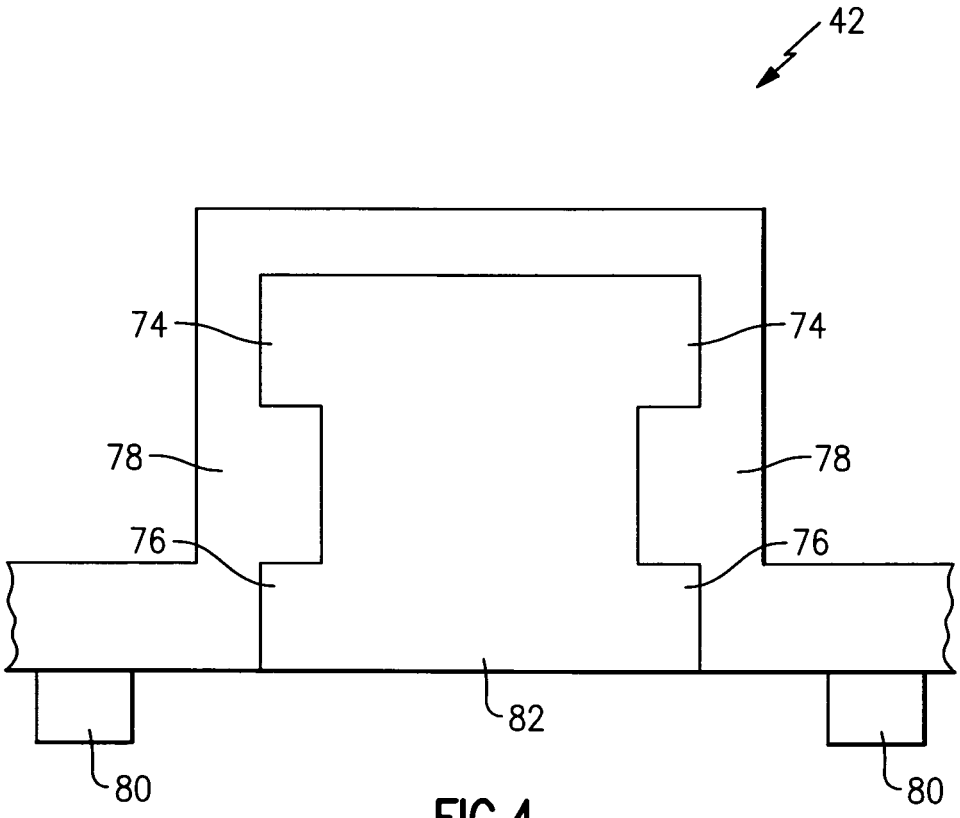
FIG. 4 is an end-view of where the clamp assembly of FIG. 3 is inserted into an opening provided in a bottom plate.

An end view of an opening, identified in general by the reference numeral 42, is shown in FIG. 4. One of the clamp assemblies 34 is inserted into the opening 42 and a remainder of the clamp assemblies 36, 38, 40 are each inserted into one of the remaining three openings 42 that are provided around an exterior surface of the bottom plate 28.

All of the openings 42 and all of the clamp assemblies 34, 36, 38, 40 are identical. Therefore, any of the clamp assemblies 34, 36, 38, 40 can be installed (i.e., pushed into) any of the openings 42 before the toilet seat 10 is placed over the rim 9 of the toilet 32.

Figure 3:
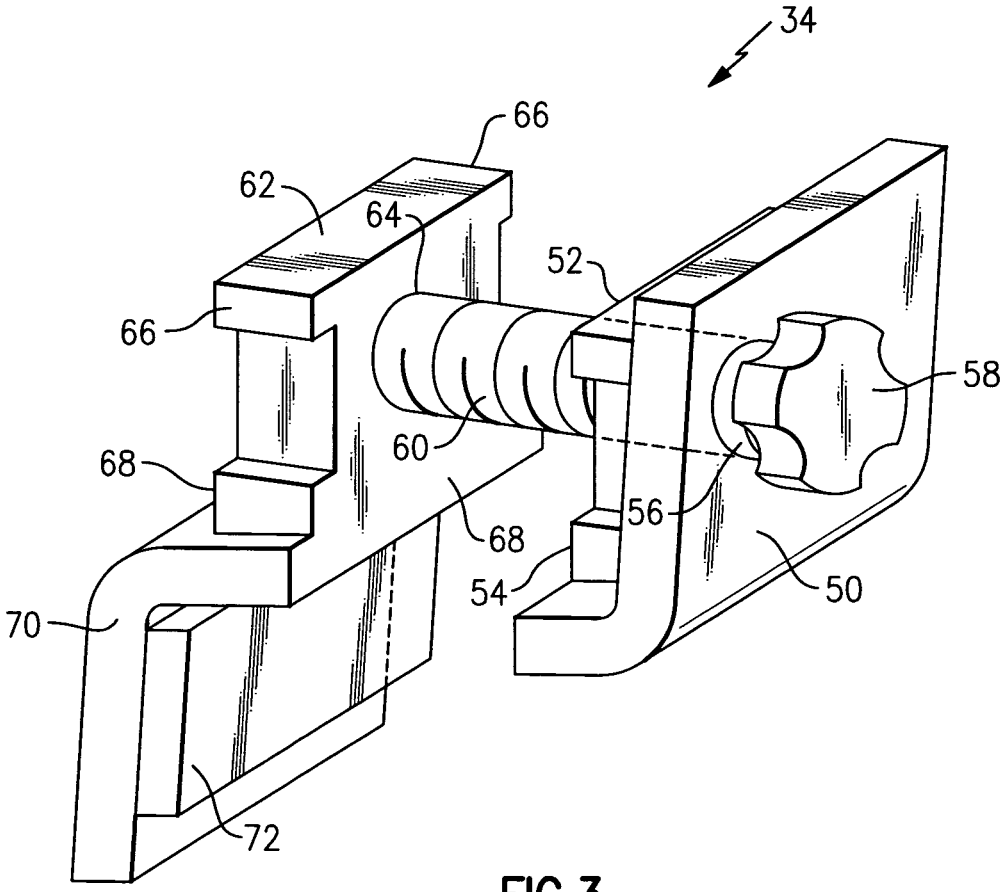
FIG. 3 is a detailed view in perspective of one of four clamp assemblies of the toilet seat of FIG. 1.

Referring now to the clamp assembly 34 shown in FIG. 3, a front plate 50 is included. The front plate 50 includes an upper front protrusion 52 that extends on opposite sides (only one side is shown) and a lower front protrusion 54 that extends on opposite sides. A clearance opening 56 is provided through the front plate 50.

A knob 58 is attached to a threaded rod 60. The threaded rod 60 extends through the clearance opening 56 but does not engage with it. A rear plate 62 includes a threaded opening 64. The threaded rod 60 engages with the threaded opening 64.

The rear plate 62 includes an upper rear protrusion 66 on both sides, thereof, and a lower rear protrusion 68 on both sides, thereof. A lower member 70 is attached to the rear plate 62 and extends downward, below the bottom surface of the toilet seat 10 and below an upper surface of the rim 9 when the toilet seat 10 is placed on the rim 9.

A foam member 72 is attached to a side of the lower member 70 closest to the knob 58.

Before installation, the knob 58 of each of the clamp assemblies 34, 36, 38, 40 is first rotated in a counter-clockwise direction to urge the rear plate 62 maximally away from the knob 58.

The rear plate 62 is aligned with each opening 42 and each one of the clamp assemblies 34, 36, 38, 40 is progressively urged into each of the four openings 42. During insertion, the upper rear protrusions 66 engage in corresponding left and right portions of an upper channel 74 of the opening 42 (See FIG. 4). During insertion, the lower rear protrusions 68 simultaneously engage in corresponding left and right portions of a lower channel 76 of the opening 42.

The upper and lower channels 74, 76 extend inward longitudinally along the depth of the opening 42. The upper rear protrusions 66 and the lower rear protrusions 68 fit loosely into the upper and lower channels 74, 76 and are therefore able to slide along a longitudinal length of the upper and lower channels 74, 76.

Each of the clamp assemblies 34, 36, 38, 40 is progressively urged into the opening 42 until the upper front protrusions 52 and the lower front protrusions 54 also engage with the upper and the lower channels 74 and 76, respectively. A pair of rails 78 are disposed between the upper channels 74 and the lower channels 76. The rails 78 protrude inward from the opening 42 and extend longitudinally along the depth of the opening 42.

The upper front protrusions 52 and the lower front protrusions 54 frictionally engage with the upper and lower channels 74, 76 sufficient to retain each one of the clamp assemblies 34, 36, 38, 40 in its corresponding opening 42. When fully inserted into each opening 42, an inside surface of the front plate 50 is disposed against an outer surface of the opening 42 and parallel with an exterior surface of the toilet seat 10.

The toilet seat 10 is then placed atop the rim 9 and the clamp assemblies 34, 36, 38, 40 are each tightened in turn a small amount with urges each lower member 70 and each foam member 72 closer toward each knob 58. Eventually, the foam members 72 each contact an inside surface of the rim 9 and, after sufficient tightening, secure the toilet seat 10 in position on the rim 9.

Offset on opposite sides of each opening 42 are included two downward protrusions 80 that extend downward from the bottom plate 28. Accordingly, eight of the downward protrusions 80 are included with the toilet seat 10 although a greater or lesser number is possible.

When the toilet seat 10 is disposed on the rim 9, a bottom of each of the downward protrusions 80 is in contact with an upper surface of the rim 9. Accordingly, the downward protrusions 80 are used to elevate the bottom surface of the bottom plate 28 slightly above the rim 9.

At an inmost portion of each of the openings 42 an inner wall 82 is included that covers the inside of each opening 42. The inner wall 82 provides a smooth continuous inner surface of the inner surface of the toilet seat 10. This is important in that it prevents any fecal matter or other discharge from the body from entering into the opening 42.

While the use of the four clamp assemblies 34, 36, 38, 40 is preferred, it is to be understood that a fewer or greater number of the clamp assemblies 34, 36, 38, 40 is possible. For example, the use and approximate equidistant spacing of any three of the four clamp assemblies 34, 36, 38, 40 on a modified version of the toilet seat 10 is possible and could be used to similarly secure the modified version to the rim 9.

If desired, the use and diametric spacing of any two of the four clamp assemblies 34, 36, 38, 40 could also be similarly used. If desired, the use of any one of the four clamp assemblies 34, 36, 38, 40 is possible by placing the one assembly where desired on a further modified version of the toilet seat 10 and providing a rim protrusion that extends downward from the bottom plate 28 on a side of the further modified version that is opposite where the one assembly is disposed. During use, the rim protrusion would engage with an inside surface of the rim 9. Tightening of the one assembly would supply sufficient tension to secure the further modified version in position.

If desired, additional assemblies (not shown) could also be included, however use of the four clamp assemblies 34, 36, 38, 40 is generally more than sufficient to secure the toilet seat 10 in position on the rim 9.

The toilet seat 10 may also be used on any type of the toilet 32 that is intended for use by children or infants (i.e., it can be sized for children or infants).

It is also possible to place the toilet seat 10 on the conventional toilet seat 8, although this is not generally preferred. Modification to the clamp assemblies 34, 36, 38, 40 to lengthen them and to lengthen the openings 42 is required if it is desired to secure a modified version of the toilet seat 10 to the conventional toilet seat 8 or to a toilet seat of any type of commode (not shown).

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A seat for use with a toilet that includes a left side and a right side when viewed from the front, wherein the improvement comprises a side opening that is provided on the left side of the seat or on the right side of the seat or on the left side of the seat and on the right side of the seat, and wherein the side opening passes through the seat and wherein at least a portion of the opening is bounded on all sides by a surrounding portion of the seat, and wherein the side opening includes a size that is sufficient to permit a hand and a portion of an arm of a person sitting on the seat to pass through the opening and for at least a portion of the hand of the person to contact an anus of the person.

2. The seat of claim 1 wherein the side opening is disposed approximately halfway between a front of the seat and a rear of the seat.

3. The seat of claim 1 wherein the left side of the seat includes a left upper portion that includes an upper surface that is on the same plane as an upper surface of a rear portion of the seat and on the same plane as an upper surface of a front portion of the seat, and wherein the left upper portion is disposed over the side opening that is provided on the left side of the seat.

4. The seat of claim 3 wherein the left upper portion is flush with an interior perimeter of a center opening of the seat.

5. The seat of claim 4 wherein the left upper portion includes a width that is less than a width of the rear portion of the seat that is adjacent to the left upper portion, and wherein the left upper portion includes a width that is less than a width of the front portion of the seat that is adjacent to the left upper portion.

6. The seat of claim 4 wherein the left upper portion includes a thickness that is less than a thickness of the rear portion of the seat that is adjacent to the left upper portion, and wherein the left upper portion includes a thickness that is less than a thickness of the front portion of the seat that is adjacent to the left upper portion.

7. The seat of claim 6, wherein the left side of the seat includes a left lower portion that includes a lower surface that is on the same plane as a lower surface of the rear portion of the seat and on the same plane as a lower surface of the front portion of the seat, and wherein the left lower portion is disposed under the side opening that is provided on the left side of the seat, and wherein an interior surface of the left lower portion is flush with the interior perimeter of a center opening of the seat, and wherein an exterior surface of the left lower portion is flush with an exterior perimeter of the seat, and wherein the left lower portion includes a thickness that is less than the thickness of the rear portion of the seat that is adjacent to the left lower portion, and wherein the left lower portion includes a thickness that is less than the thickness of the front portion of the seat that is adjacent to the left lower portion.

8. The seat of claim 1 wherein the right side of the seat includes a right portion that includes an upper surface that is on the same plane as an upper surface of a rear portion of the seat and on the same plane as an upper surface of a front portion of the seat, and wherein the right portion is disposed over the side opening that is provided on a right side of the seat.

9. The seat of claim 8 wherein the right portion is flush with an interior perimeter of a center opening of the seat.

10. The seat of claim 9 wherein the right portion includes a width that is less than a width of the rear portion of the seat that is adjacent to the right portion, and wherein the right portion includes a width that is less than a width of the front portion of the seat that is adjacent to the right portion.

11. The seat of claim 9 wherein the right portion includes a thickness that is less than a thickness of the rear portion of the seat that is adjacent to the right portion, and wherein the right portion includes a thickness that is less than a thickness of the front portion of the seat that is adjacent to the right portion.

12. The seat of claim 11, wherein the right side of the seat includes a right lower portion that includes a lower surface that is on the same plane as a lower surface of the rear portion of the seat and on the same plane as a lower surface of the front portion of the seat, and wherein the right lower portion is disposed under the side opening that is provided on the right side of the seat, and wherein an interior surface of the right lower portion is flush with the interior perimeter of a center opening of the seat, and wherein an exterior surface of the right lower portion is flush with an exterior perimeter of the seat, and wherein the right lower portion includes a thickness that is less than the thickness of the rear portion of the seat that is adjacent to the right lower portion, and wherein the right lower portion includes a thickness that is less than the thickness of the front portion of the seat that is adjacent to the right lower portion.

13. A toilet seat for use with a toilet, comprising:

(a) a toilet seat that includes a generally circular or oval shape, and wherein said toilet seat includes a center opening and an inner perimeter around said center opening, and an outer perimeter; and (b) a side access opening that is disposed on a left side of the toilet seat or on a right side of the toilet seat or on both said left side and said right side of the toilet seat, and wherein said side access opening includes a height that is less than a maximum thickness of said toilet seat, and wherein said side access opening includes a length that is sufficient to permit a person that is sitting on said toilet seat to insert their hand and a portion of their arm through said side access opening sufficient to reach their anus for cleaning, and wherein the side access opening passes through the seat and wherein at least a portion of the side access opening is bounded on all sides by a surrounding portion of the seat;

wherein said toilet seat includes at least one clamp, and wherein said at least one clamp extends downward from a bottom surface of said toilet seat, and wherein said at least one clamp contacts an interior of a rim of a toilet bowl that said toilet seat is disposed upon when said toilet seat is disposed on top of said toilet bowl and parallel with respect to a plane of said rim of said toilet bowl.

14. The toilet seat of claim 13 wherein said side access opening is disposed under an upper portion of said toilet seat that extends from a front portion of said toilet seat to a rear portion of said toilet seat, and wherein said upper portion of said toilet seat that is disposed over said side access opening includes a width that is less than a width of said front portion of said toilet seat, and wherein said upper portion of said toilet seat that is disposed over said side access opening includes a width that is less than a width of said rear portion of said toilet seat, and wherein said side access opening is disposed over a lower portion of said toilet seat that extends from said front portion of said toilet seat to said rear portion of said toilet seat, and wherein said lower portion of said toilet seat that is disposed under said side access opening includes a width that is equal to said width of said front portion of said toilet seat, and wherein said lower portion of said toilet seat that is disposed under said side access opening includes a width that is equal to said width of said rear portion of said toilet seat.

15. The toilet seat of claim 13 wherein a position of said at least one clamp is adjustable with respect to said toilet seat.

16. The toilet seat of claim 15 wherein said position of said at least one clamp is adjustable with respect to a center of said toilet seat, and wherein said at least one clamp is able to be extended radially away from said center or radially toward said center, and including means for securing said at least one clamp in a desired position with respect to said toilet seat.

17. The seat of claim 1 including at least one clamp assembly, wherein said at least one clamp assembly includes a portion that extends downward from a bottom surface of the seat and is able to contact an interior surface of a rim of a toilet bowl.

18. The seat of claim 17 wherein a position of said at least one clamp is adjustable with respect to the seat, and wherein said position of said at least one clamp is adjustable with respect to a center of the seat, and wherein said at least one clamp is able to be extended radially away from said center or radially toward said center, and including means for securing said at least one clamp in a desired position with respect to the seat.

19. The seat of claim 13 wherein said clamp includes a clamp assembly, and wherein a portion of said clamp assembly is disposed in a channel provided in the seat.

* * * * *